US009021800B2

(12) United States Patent
Kwok et al.

(10) Patent No.: US 9,021,800 B2
(45) Date of Patent: May 5, 2015

(54) HEAT EXCHANGER AND ASSOCIATED METHOD EMPLOYING A STIRLING ENGINE

(75) Inventors: David W. Kwok, La Miranda, CA (US); Jack W. Mauldin, Long Beach, CA (US)

(73) Assignee: The Boeing Company, Chicago, IL (US)

( * ) Notice: Subject to any disclaimer, the term of this patent is extended or adjusted under 35 U.S.C. 154(b) by 700 days.

(21) Appl. No.: 13/053,470

(22) Filed: Mar. 22, 2011

(65) Prior Publication Data

US 2012/0240570 A1 Sep. 27, 2012

(51) Int. Cl.

| | |
|---|---|
| ***F01B 13/02*** | (2006.01) |
| ***F01B 13/04*** | (2006.01) |
| ***F02G 1/043*** | (2006.01) |
| ***F02G 1/044*** | (2006.01) |
| ***F02G 1/053*** | (2006.01) |
| ***F28D 1/02*** | (2006.01) |

(52) U.S. Cl.

CPC ..... *F02G 1/043* (2013.01); *F02G 2280/50* (2013.01); *F28F 2250/08* (2013.01); *F28D 1/024* (2013.01)

(58) Field of Classification Search

USPC ..... 60/517–520

See application file for complete search history.

(56) References Cited

U.S. PATENT DOCUMENTS

| | | | | |
|---|---|---|---|---|
| 3,477,226 | A * | 11/1969 | Percival | 60/517 |
| 3,563,028 | A | 2/1971 | Goranson et al. | |
| 3,822,388 | A | 7/1974 | Martini et al. | |
| 3,961,483 | A | 6/1976 | Wiley | |
| 4,573,320 | A * | 3/1986 | Kralick | 60/517 |
| 4,583,520 | A | 4/1986 | Dietrich et al. | |
| 5,509,604 | A | 4/1996 | Chung | |
| 5,899,071 | A | 5/1999 | Stone et al. | |
| 6,735,946 | B1 | 5/2004 | Otting et al. | |
| 6,871,495 | B2 | 3/2005 | Lynch et al. | |
| 6,886,339 | B2 | 5/2005 | Carroll et al. | |
| 7,436,104 | B2 | 10/2008 | Clingman et al. | |
| 2007/0289300 | A1 * | 12/2007 | Lin | 60/517 |
| 2009/0320830 | A1 | 12/2009 | Bennett | |

FOREIGN PATENT DOCUMENTS

| | | | |
|---|---|---|---|
| DE | 102007062096 | A1 * | 6/2009 |
| GB | 2437309 | A * | 10/2007 |

OTHER PUBLICATIONS

English Translation of DE 102007062096 A1.*

(Continued)

*Primary Examiner* — Thomas Denion
*Assistant Examiner* — Jessica Kebea
(74) *Attorney, Agent, or Firm* — Alston & Bird LLP

(57) ABSTRACT

A heat exchanger and associated method are provided that may eliminate or reduce the need for an external mechanical or electrical power source to drive the fan by utilization, instead, of a Stirling engine. A heat exchanger includes a plurality of coils configured to carry a primary fluid. The heat exchanger also includes a fan including a plurality of fan blades configured to force a secondary fluid across the plurality of coils to facilitate heat transfer between the primary and secondary fluids. The heat exchanger also includes a Stirling engine operably connected to the fan and configured to cause rotation of the fan blades. A corresponding method is also provided.

15 Claims, 6 Drawing Sheets

(56) References Cited

OTHER PUBLICATIONS

Quasiturbine Stirling Engine (Sterling)—Rotary Hot Air Motor—Heat Pump [online] [retrieved Feb. 18, 2011]. Retrieved from the Internet: <URL: http://quasiturbine.promci.qc.ca/QTStirling.html>. 9 pages.

Stirling Engine Motherboard Fans Powered by Waste Chip Heat—Boing Boing [online] [retrieved Feb. 18, 2011]. Retrieved from the Internet: <URL: http://gadgets.boingboing.net/2008/02/29/stirling-engine-moth.html>. 2 pages.

Liquid Piston Stirling Engine—MEPS [online] [retrieved Feb. 18, 2011]. Retrieved from the Internet: <URL: http://www2.me.wpi.edu/MEPS/index.php/Liquid-Piston_Stirling_Engine>. 3 pages.

Stirling engine—Made in Germany [online] [retrieved Feb. 18, 2011]. Retrieved from the Internet: <URL: http://stirlingshop.com/>. 2 pages.

Science: stirling engine powered cpu cooler |kanabona.com [online] [retrieved Feb. 18, 2011]. Retrieved from the Internet: <URL: http://www.kanabona.com/science_stirling_engine_powered_cpu_cooler>. 5 pages.

YouTube—Hot Air Stirling Engine FAN 12 450 RPMs [online] [retrieved Feb. 18, 2011]. Retrieved from the Internet: <URL: http://www.youtube.com/watch?v=NBpR15eF3fc&feature=related>. 1 page.

* cited by examiner

HEAT EXCHANGER AND ASSOCIATED METHOD EMPLOYING A STIRLING ENGINE

TECHNOLOGICAL FIELD

Embodiments of the present disclosure relate generally to heat exchangers and associated methods and, more particularly, to heat exchangers and associated methods that utilize a fan to increase the heat transfer rate.

BACKGROUND

It is desirable in many applications to provide for heat transfer, such as to either heat or cool a fluid or other workpiece. For example, a heat exchanger may remove waste heat from a mechanical or electrical system, such as an air conditioning condenser. One form of heat transfer is convective heat transfer. However, convective heat transfer is not generally very efficient. Indeed, to transfer heat, particularly a relatively large amount of heat, from one fluid to another, utilizing convective heat transfer, a relatively large heat transfer surface must generally be provided. To provide an expansive heat transfer surface, heat exchangers have been developed that include a plurality of coils configured to carry a primary fluid. As such, heat is either transferred from or to the primary fluid circulating through the heat exchanger as a result of heat transfer between the primary fluid and a secondary fluid that surrounds and flows over the heat transfer surface of the heat exchanger.

In order to increase the heat transfer rate, a heat exchanger may include a fan that forces a secondary fluid across the coils of the heat exchanger. While the movement of the secondary fluid across the coils of the heat exchanger increases the heat transfer rate, the increase in the heat transfer rate comes at the expense of the energy required to operate the fan. In this regard, the fan may be electrically actuated so as to consume electrical energy during its operation. For example, a fan may be driven by an electrical motor. Alternatively, the fan may be driven by a mechanical source so as to consume mechanical energy during its operation. For example, the radiator fan of some automobiles may be driven by the rotational energy provided by the engine drive shaft. In either instance, the fan increases the energy consumption of a heat exchanger. As the fan is generally configured to be activated so long as heat transfer is required, the fan may consume energy over a fairly long period of time, thereby correspondingly increasing the operating costs and the carbon footprint of the heat exchanger.

In addition, in instances in which the fan is driven by electrical energy from an electrical power source, electrical wires generally extend from the electrical power source to the fan. In some applications, the routing, placement and handling of the electrical wiring may prove challenging, such as in instances in which the wiring must be routed over or along a hinge or other moveable joint.

As such, it would be desirable to provide a heat exchanger that consumes less energy, such as from an external electrical or mechanical power source, and that has a smaller carbon footprint. It would also therefore be desirable to provide a heat exchanger that did require wiring that potentially had to be routed over or along a hinge or other moveable joint.

BRIEF SUMMARY

A heat exchanger and associated method are provided according to embodiments of the present disclosure that may reduce or eliminate the energy costs and carbon footprint of a heat exchanger. In this regard, the heat exchanger and method of one embodiment may eliminate or reduce the need for an external mechanical or electrical power source to drive the fan. The heat exchanger and method of one embodiment may also eliminate any requirement that electrical wiring extend from an electrical power source to the fan.

A heat exchanger in accordance with one embodiment includes a plurality of coils configured to carry a primary fluid. The heat exchanger also includes a fan including a plurality of fan blades configured to force a secondary fluid across the plurality of coils to facilitate heat transfer between the primary and secondary fluids. The heat exchanger of this embodiment also includes a Stirling engine operably connected to the fan and configured to cause rotation of the fan blades. While the heat exchanger of one embodiment may include a single Stirling engine operably connected to the fan, the heat exchanger of other embodiments may include a plurality of Stirling engines operably connected to the fan and configured to cooperate to cause rotation of the fan blades.

The Stirling engine may include at least one piston and first and second regions containing fluid. As such, the Stirling engine of one embodiment may be positioned relative to the fan such that the first region of the Stirling engine is outside of the flow of the secondary fluid and the second region of the Stirling engine is at least partially within the flow of the secondary fluid, thereby creating a temperature differential between the first and second regions.

The plurality of coils may include an inlet and an outlet through which the primary fluid enters and exits the plurality of coils, respectively. The primary fluid at the inlet and the outlet has different temperatures as a result of the heat transfer. As such, the primary fluid at one of the inlet or the outlet is warmer and therefore is considered warmer fluid than the primary fluid at the other of the inlet or the outlet that is considered cooler fluid. In one embodiment, the fluid within the first region of the Stirling engine is in communication with the warmer fluid. For example, the first region of the Stirling engine may be at least partially disposed within the warmer fluid. Alternatively, the inlet may extend at least partially alongside the first region of the Stirling engine. In addition to or instead of the fluid within the first region of the Stirling engine being in communication with the warmer fluid, the fluid within the second region of the Stirling engine may, in one embodiment, be in thermal communication with the cooler fluid.

The plurality of coils may include first and second sets of coils with the primary fluid being warmer in the first set of coils than in the second set of coils. In this embodiment, the fluid within the first region of the Stirling engine may be in thermal communication with the first set of coils. Additionally or alternatively, the fluid within the second region of the Stirling engine may be in thermal communication with the second set of coils.

In another embodiment, a method is provided that includes circulating a primary fluid through a plurality of coils and providing for a temperature differential between first and second fluid-containing regions of the Stirling engine so as to cause rotation of a plurality of fan blades of a fan. The method also includes forcing a secondary fluid across the plurality of coils as a result of the rotation of the plurality of fan blades to facilitate heat transfer between the primary and secondary fluids.

In one embodiment, the circulation of the primary fluid includes permitting the primary fluid to enter and exit the plurality of coils through an inlet and an outlet, respectively. The primary fluid at the inlet and the outlet has different temperatures as a result of the heat transfer such that primary fluid at one of the inlet or the outlet is warmer and is therefore considered warmer fluid than the primary fluid at the other of the inlet or the outlet that is considered cooler fluid. In this embodiment, the provision of the temperature differential may include providing for the fluid within the first region of the Stirling engine to be in thermal communication with the warmer fluid. For example, the first region of the Stirling engine may be at least partially disposed within the warmer fluid. Alternatively, the inlet may be positioned so as to extend at least partially alongside the first region of the Stirling engine. Additionally or alternatively, the provision of the temperature differential may include providing for the fluid within the second region of the Stirling engine to be in thermal communication with the cooler fluid.

The plurality of coils of one embodiment may include first and second sets of coils with the primary fluid being warmer in the first set of coils than in the second set of coils. In this embodiment, the method may provide for the temperature differential by providing for the fluid within the first region of the Stirling engine to be in thermal communication with the first set of coils. Additionally or alternatively, the method of this embodiment may provide for the temperature differential by providing for the fluid within the second region of the Stirling engine to be in thermal communication with the second set of coils. The method of one embodiment may also provide for the temperature differential by positioning the Stirling engine relative to the fan such that the first region of the Stirling engine is outside of a flow of the secondary fluid and the second region of the Stirling engine is at least partially within the flow of the secondary fluid.

In accordance with embodiments of the heat exchanger and associated method, the fan may be driven so as to rotate the fan blades in an energy efficient and environmentally friendly manner. However, the features, functions and advantages that have been discussed may be achieved independently in various embodiments of the present disclosure and may be combined in yet other embodiments, further details of which may be seen with reference to the following descriptions and drawings.

BRIEF DESCRIPTION OF THE SEVERAL VIEWS OF THE DRAWINGS

Figure 1:
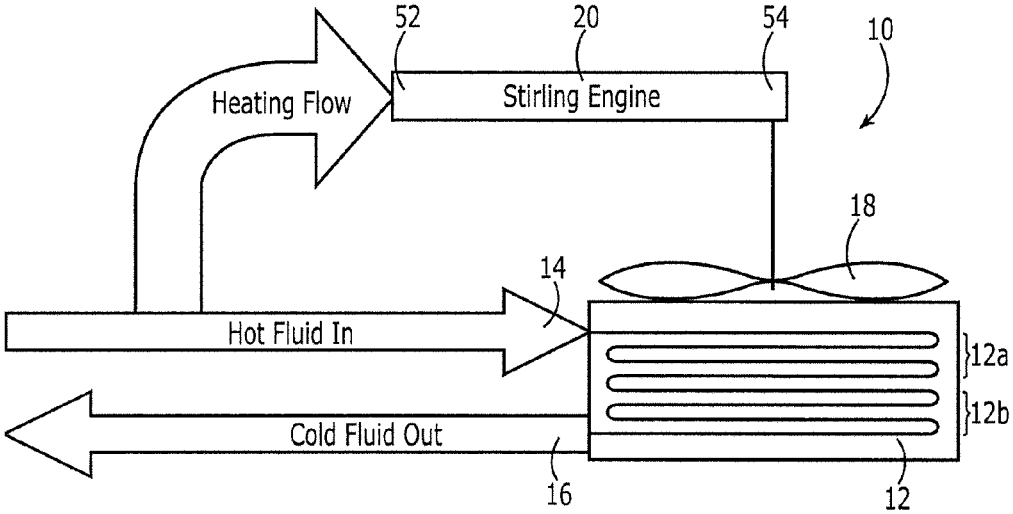
Figure 2:
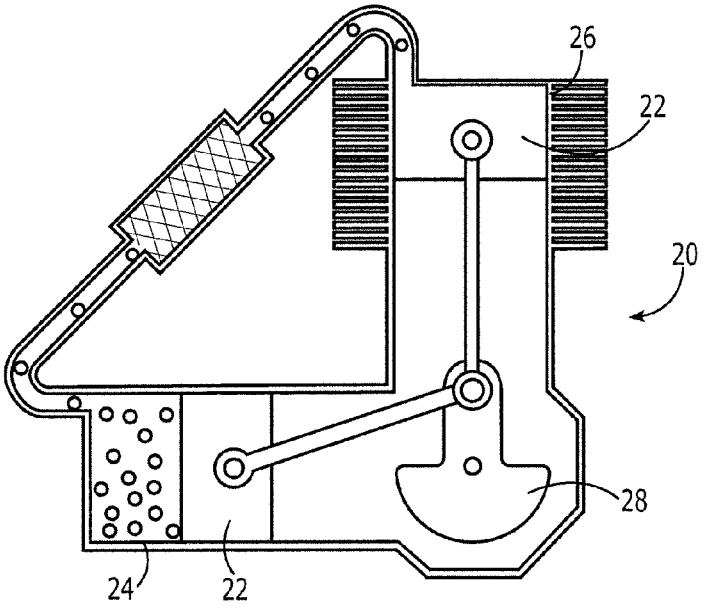
FIGURE 2 (PRIOR ART)
Figure 3:
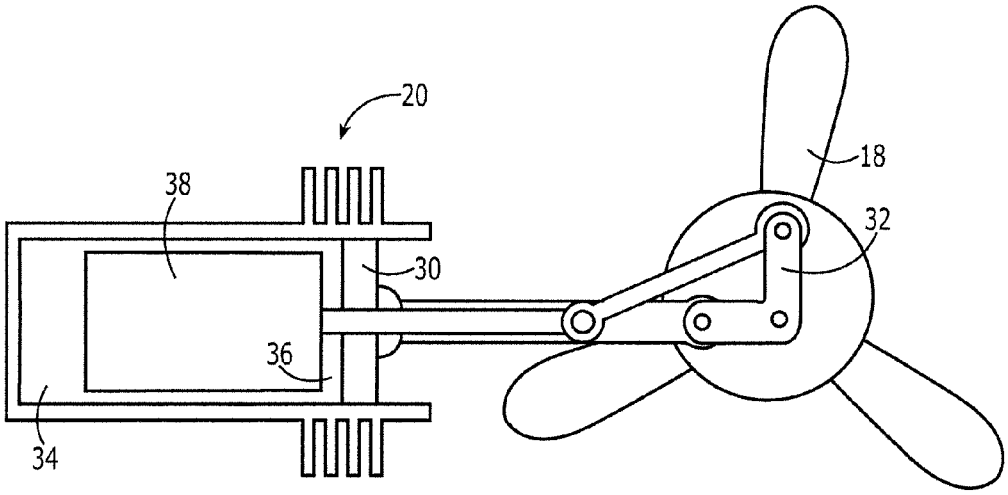
FIGURE 3 (PRIOR ART)
Figure 4:
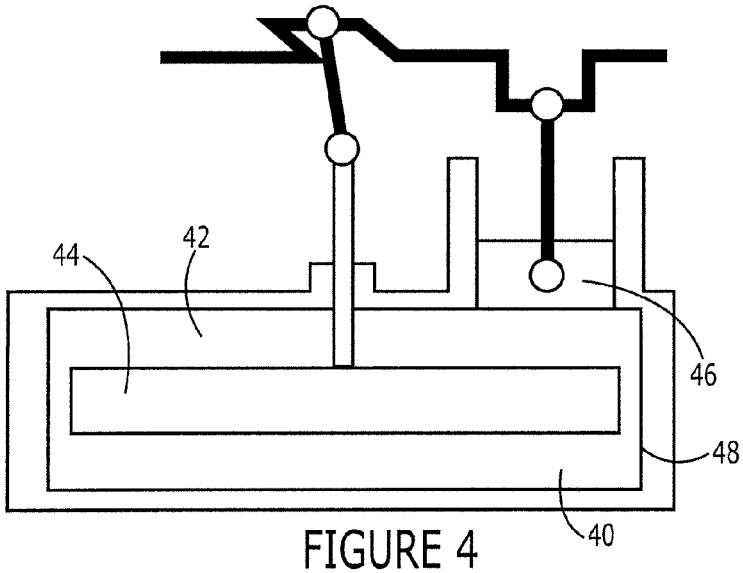
FIGURE 4 (PRIOR ART)
Figure 5:
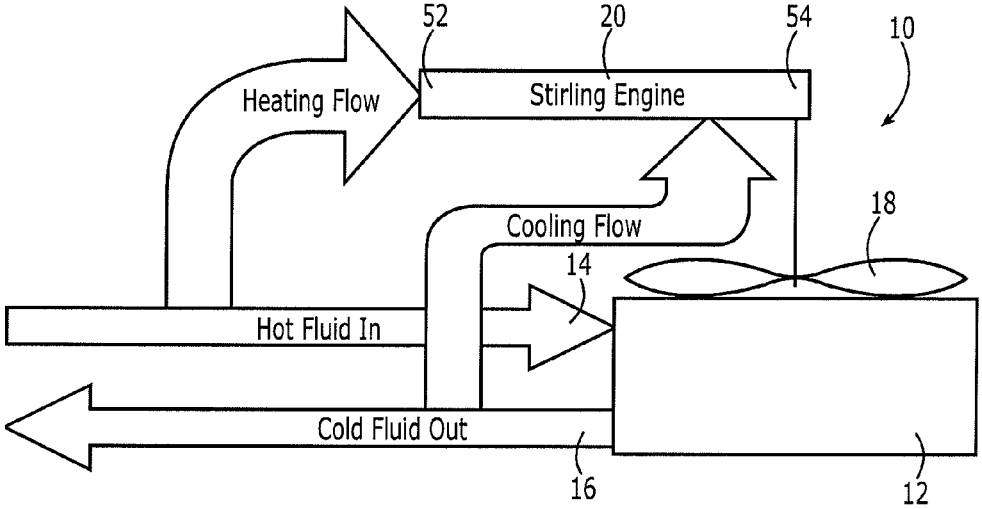
Figure 6:
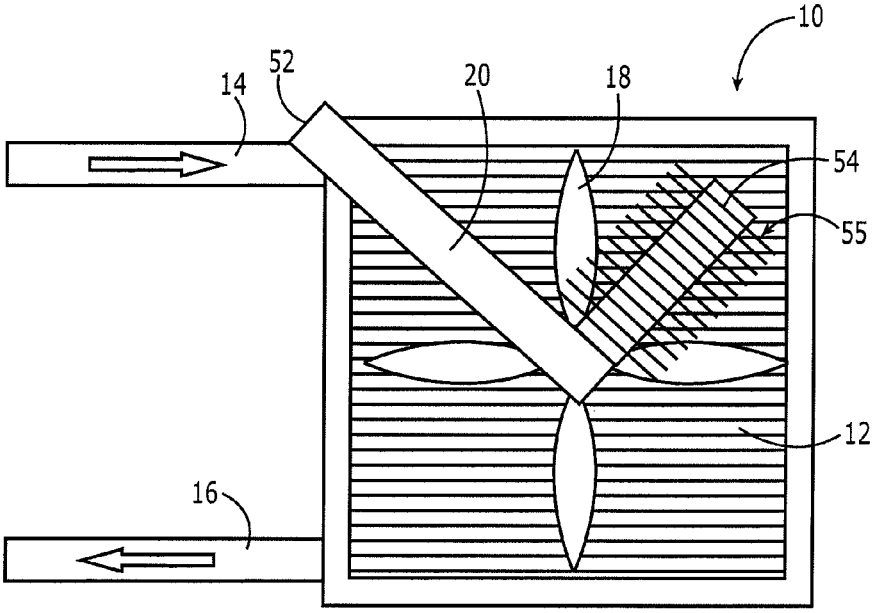
Figure 7:
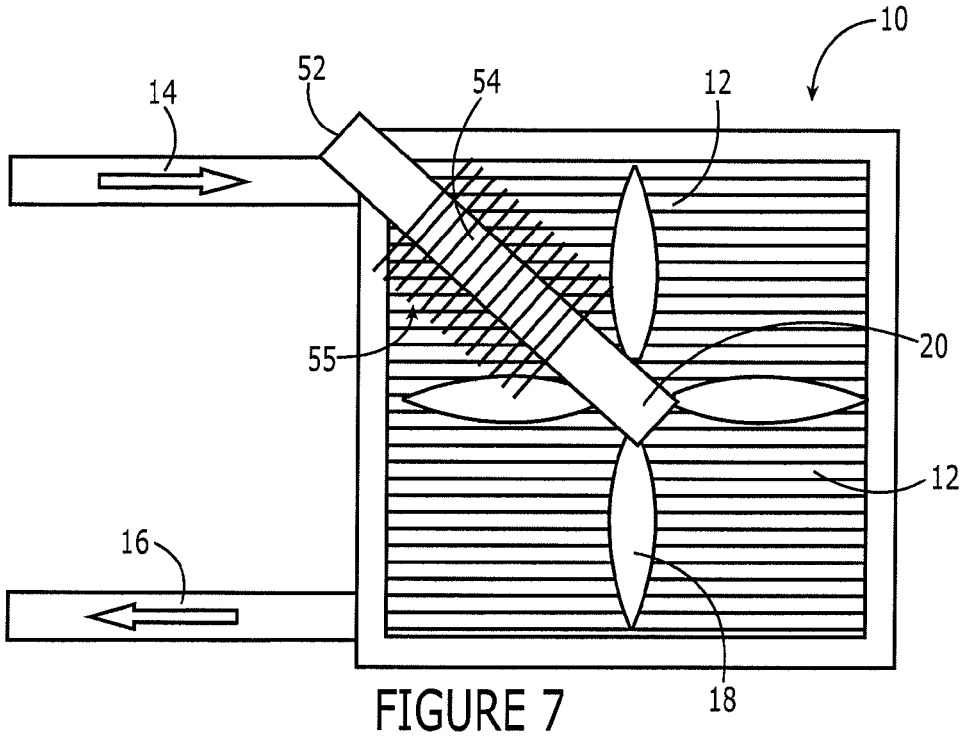
Figure 8:
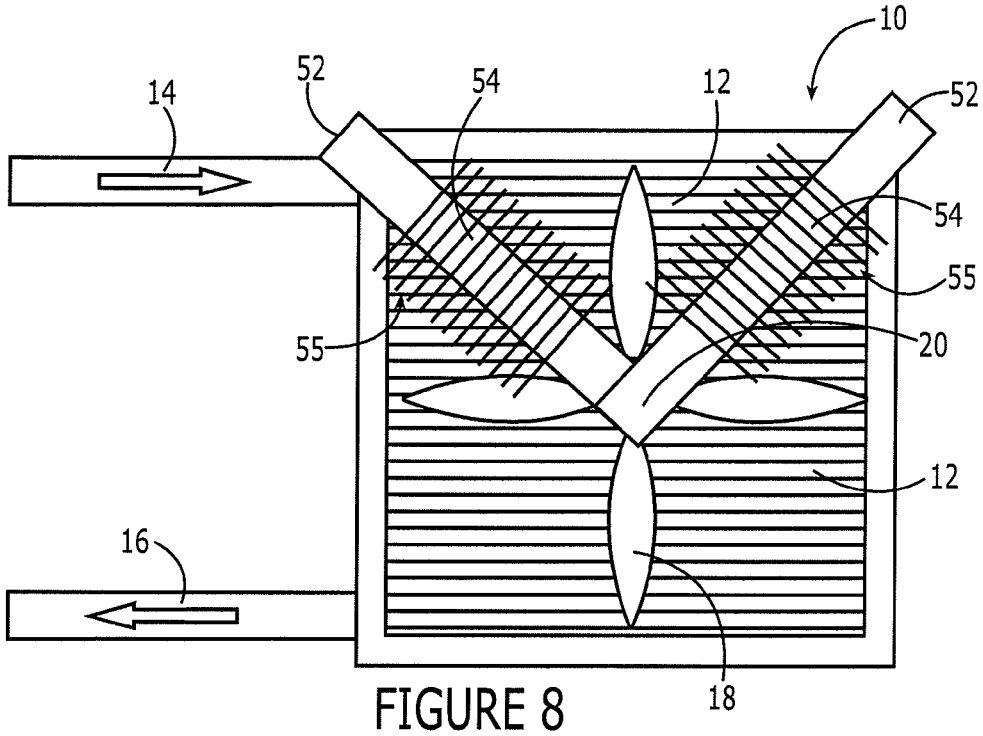
Figure 9A:
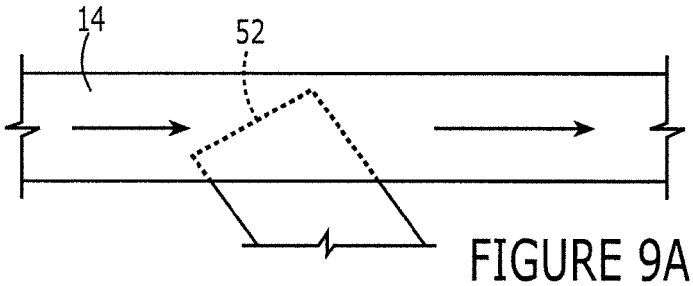
Figure 9B:
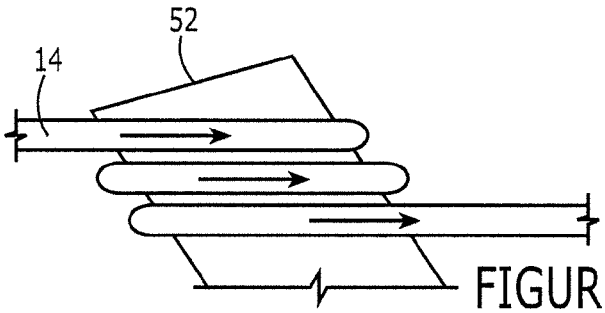
Figure 10A:
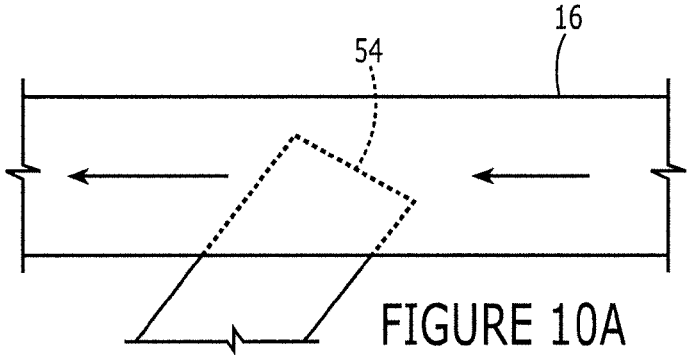
Figure 10B:
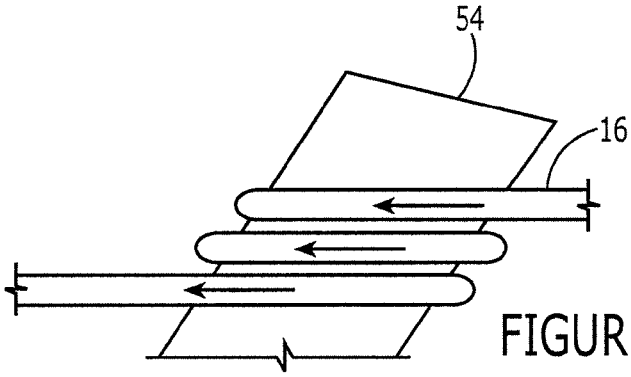
Figure 11:
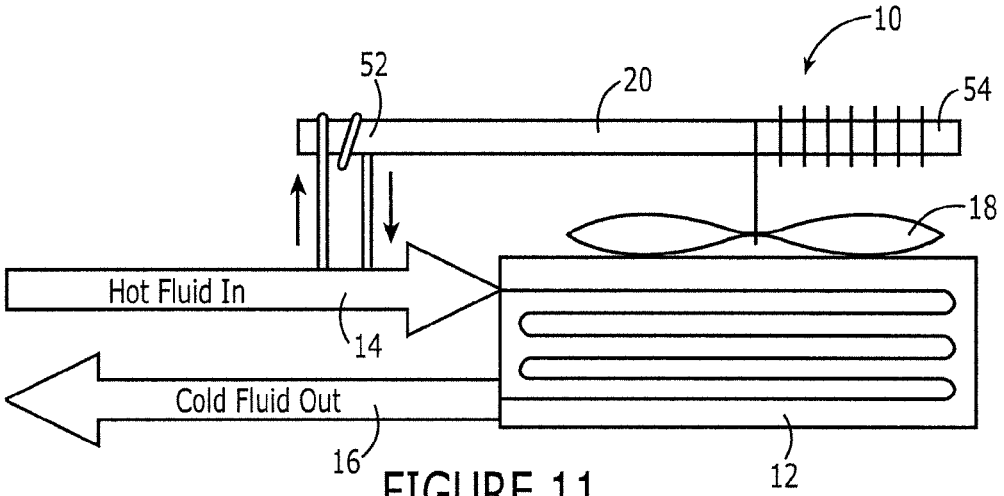
Figure 12:
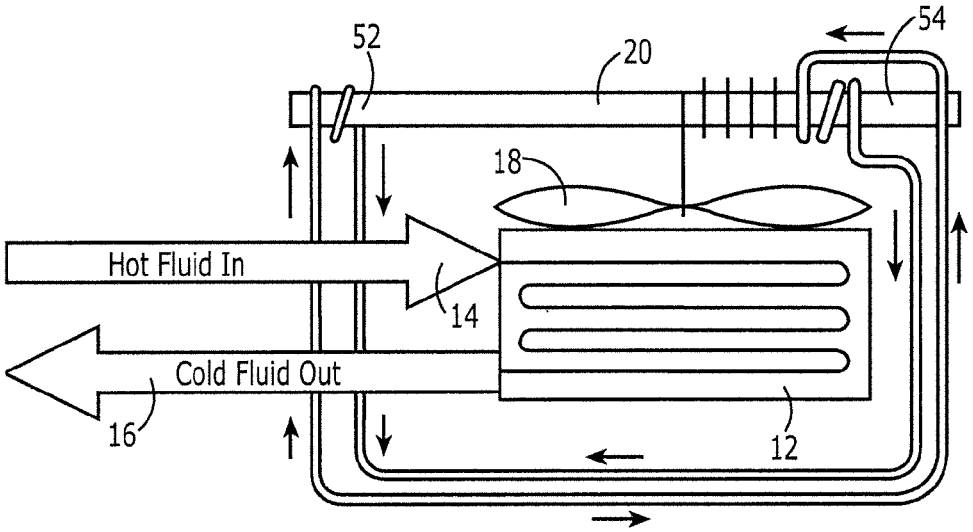

Having thus described embodiments of the present disclosure in general terms, reference will now be made to the accompanying drawings, which are not necessarily drawn to scale, and wherein:

FIG. 1 is a schematic representation of a heat exchanger in accordance with one embodiment of the present disclosure;

FIG. 2 is a schematic representation of a two-cylinder Stirling engine;

FIG. 3 is a schematic representation of a single-cylinder Stirling engine;

FIG. 4 is a schematic representation of a displacer-type Stirling engine;

FIG. 5 is a schematic representation of a heat exchanger in accordance with another embodiment of the present disclosure;

FIG. 6 is a schematic representation of a heat exchanger employing a two-cylinder Stirling engine in accordance with one embodiment to the present disclosure;

FIG. 7 is a schematic representation of a heat exchanger employing a single-cylinder Stirling engine in accordance with one embodiment to the present disclosure;

FIG. 8 is a schematic representation of a heat exchanger including two single-cylinder Stirling engines in accordance with one embodiment to the present disclosure;

FIG. 9A depicts the first region of the Stirling engine being immersed within the warmer fluid in accordance with one embodiment of the present disclosure;

FIG. 9B depicts the inlet wrapping about the first region of the Stirling engine in accordance with one embodiment of the present disclosure;

FIG. 10A depicts the second region of the Stirling engine being immersed within the cooler fluid at the outlet of the coils in accordance with one embodiment of the present disclosure;

FIG. 10B depicts the outlet wrapping about the second region of the Stirling engine in accordance with one embodiment of the present disclosure;

FIG. 11 is a schematic representation of a heat exchanger in accordance with an example embodiment of the present disclosure; and FIG. 12 is a schematic representation of a heat exchanger in accordance with another example embodiment of the present disclosure.

Embodiments of the present disclosure now will be described more fully hereinafter with reference to the accompanying drawings, in which some, but not all embodiments are shown. Indeed, these embodiments may be embodied in many different forms and should not be construed as limited to the embodiments set forth herein; rather, these embodiments are provided so that this disclosure will satisfy applicable legal requirements. Like numbers refer to like elements throughout.

A heat exchanger 10 in accordance with one embodiment of the present disclosure is illustrated in FIG. 1. The heat exchanger 10 may include a plurality of coils 12 configured to carry a primary fluid. The primary fluid that is circulated through the plurality of coils 12 may be any of a variety of fluids including various gas or liquids. The plurality of coils 12 may include an inlet 14 through which the primary fluid enters and an outlet 16 through which the primary fluid exits. During the flow of the primary fluid through the plurality of coils 12, heat may be transferred to or from the primary fluid depending upon the application. For example, the heat exchanger 10 may be employed in an application in which the primary fluid is to be cooled. As such, relatively hot fluid may enter the plurality of coils 12 through the inlet 14 and be cooled during its traversal through the plurality of coils such that a cooler fluid exits at the outlet 16. Alternatively, the heat exchanger 10 may be configured to heat a primary fluid. In an embodiment in which the primary fluid is heated, a cooler fluid may enter the plurality of coils 12 through the inlet 14 and be heated during its traversal through the plurality of coils such that a warmer fluid exits the plurality of coils at the outlet 16.

In order to improve the heat transfer with the primary fluid, the heat exchanger 10 may include a fan 18 having a plurality of fan blades configured for rotation so as to force a secondary fluid across the plurality of coils 12. As with the primary fluid, the secondary fluid may be any type of fluid including various gases or liquids. As a result of a temperature differential between the primary and secondary fluids, heat transfer may occur between the primary and secondary fluids. In the embodiment of FIG. 1 in which the primary fluid is to be cooled within the plurality of coils 12, for example, the secondary fluid that is forced across the plurality of coils may be cooler than the primary fluid that is circulating through the plurality of coils or at least cooler than the primary fluid that enters the plurality of coils through the inlet 14. In this embodiment, heat would transfer from the primary fluid as it propagates through the plurality of coils 12 to the secondary fluid, thereby cooling the primary fluid and warming the secondary fluid. Conversely, in an embodiment in which the primary fluid is to be heated during its propagation through the plurality of coils 12, the secondary fluid may be warmer than the primary fluid or, at least, warmer than the primary fluid that enters the plurality of coils through the inlet 14. In this embodiment, heat would transfer from the secondary fluid to the primary fluid, thereby cooling the secondary fluid and warming the primary fluid.

As shown in FIG. 1, the heat exchanger 10 also includes a Stirling engine 20 that is operably connected to the fan 18 and is configured to cause rotation of the fan blades. By driving the fan 18 with a Stirling engine 20, the dependence of the fan on other electrical or mechanical power for operation may be reduced or eliminated, thereby conserving energy and reducing the carbon footprint of the heat exchanger 10. In instances in which the fan 18 is driven exclusively by the Stirling engine 20, the fan no longer need be connected to an electrical power source by wires, thereby simplifying the wiring design of the platform.

A Stirling engine 20 operates on a temperature differential between a heat source and a cold sink and may provide an output in the form of a rotating power shaft. A Stirling engine 20 may be described as a closed cycle externally heated heat engine in which the working fluid is not renewed for every cycle. A Stirling engine 20 may include a variety of working fluids including air, hydrogen, helium, nitrogen, etc. Since the working fluid is in a closed loop with no exhaust, the theoretical efficiency of a Stirling-cycle heat engine 20 may approach that of a Carnot-cycle heat engine which has the highest thermal efficiency attainable by any heat engine. A Stirling engine 20 may operate over any wide range of temperature differentials including very low temperature differentials.

There are various types of Stirling engines 20. For example, a two-cylinder Stirling engine. 20 is illustrated in FIG. 2. In this configuration, two cylinders are employed to produce work, such as the rotation of a power shaft. During operation, one cylinder may be heated by exposure to an external heat source, while the other cylinder may be cooled by exposure to an external heat sink. The working fluid may be transferred between the two cylinders with the fluid expanding upon exposure to heat and being compressed when cooled. The alternate expansion and compression of the working fluid drives the two pistons 22, one of which is positioned within each cylinder of the Stirling engine 20. The pistons 22, in turn, may drive a rotating power shaft.

A Stirling engine 20 has four phases of operation, namely, expansion, transfer, contraction and transfer. In expansion, most of the working fluid has been driven into the hot cylinder 24. In the hot cylinder, the working fluid is heated and expands, both within the hot cylinder 24 and through propagation into the cold cylinder 26, thereby driving both pistons 22 inward. The movement of both pistons 22 inward may rotate the crankshaft 28 by about 90 degrees. Following expansion of the working fluid and rotation of the crankshaft 28 by about 90 degrees, the majority of the working fluid, such as about two-thirds of the working fluid, may still be located in the hot cylinder 24. However, flywheel momentum may cause the crankshaft 28 to continue to rotate for about another 90 degrees, thereby causing the majority of the working fluid to be transferred to the cold cylinder 26. In the cold cylinder 26, the working fluid is cooled and contracts, thereby drawing both pistons 22 outward and causing the crankshaft 28 to rotate another 90 degrees. With the contracted gas still located in the cold cylinder 26, flywheel momentum may again cause the crankshaft 28 to continue to rotate by about another 90 degrees, thereby transferring the working fluid back to the hot cylinder 24 to complete the cycle. As will be apparent from the foregoing discussion, the designations of the cylinders as hot and cold are relative terms and employed to indicate that the working fluid is heated within the hot cylinder 24 and cooled within the cold cylinder 26.

An alternative type of Stirling engine 20 is a single cylinder Stirling engine that has four phases of operation, namely, expansion, transfer, contraction and transfer. As shown in FIG. 3, a single cylinder Stirling engine 20 may include a single piston 30 connected to a crankshaft 32. The single cylinder has opposed hot and cold ends 34, 36 with the working fluid being heated in the hot end and the working fluid being cooled in the cold end. In expansion, the majority of the working fluid is disposed at the hot end 34 of the cylinder. While in the hot end 34 of the cylinder, the working fluid is heated and expands, driving the piston 30 outward, e.g., to the right in the embodiment illustrated in FIG. 3, and causing the crankshaft 32 to rotate about 90 degrees. Following expansion of the working fluid, the majority of the working fluid is still located at the hot end 34 of the cylinder. However, flywheel momentum may cause the crankshaft 32 to continue to rotate about another 90 degrees. This further rotation of the crankshaft 32 will cause the majority of the gas to move around the displacer 38 from the hot end 34 to the cool end 36 of the single cylinder. At the cool end 36, the working fluid is cooled and contracts, thereby drawing the piston 30 inward, which causes the crankshaft 32 to rotate through about another 90 degrees. At this stage, the contracted working fluid is still located near the cool end 36 of the cylinder. However, flywheel momentum may again continue to rotate the crankshaft 32 about another 90 degrees, thereby moving the displacer 38 and returning the majority of the working fluid to the hot end 34 of the cylinder.

As shown in FIG. 4, another type of Stirling engine 20 is a displacer Stirling engine. The operation of a displacer Stirling engine 20 is similar to a single cylinder Stirling engine with the exception that the heat transfer surfaces for both the hot and cold sides 40, 42 of the displacer 44 are expanded to capture and eject heat more efficiently. This increase in the heat transfer rate enables a displacer-type Stirling engine 20 to operate between heat sources and heat sinks that have a relatively low temperature differential. In further contrast to a single cylinder Stirling engine, the drive piston 46 for a displacer-type Stirling engine may be external to the chamber 48 that contains the working fluid.

Regardless of the type of Stirling engine 20, the Stirling engine may include first and second regions 52, 54 containing fluid. As described above, in conjunction with the Stirling engines 20 of FIGS. 2-4, a temperature differential may be created between the first and second fluid-containing regions 52, 54 of the Stirling engine. For example, the first fluid-containing region 52 may be heated and/or the second fluid-containing region 54 may be cooled. As a result of this temperature differential, the Stirling engine 20 may drive a rotating drive shaft that, in turn, is operably connected to the fan 18 so as to cause rotation of the fan blades and the forced circulation of the secondary fluid through the plurality of coils 12.

The temperature differential between the first and second fluid-containing regions 52, 54 of the Stirling engine 20 may be created in a variety of different manners. For example, the temperature differential may be created by utilizing the temperature differential between the primary fluid that enters and exits the plurality of coils 12. In this regard, as a result of the heat transfer that occurs during propagation of the primary fluid through the plurality of coils 12, the primary fluid at the inlet 14 of the plurality of coils has a different temperature than the primary fluid at the outlet 16 of the plurality of coils. Thus, the primary fluid at one of the inlet 14 or the outlet 16 is warmer and therefore is considered warmer fluid than the primary fluid at the other of the inlet or outlet that is considered a cooler fluid. In the embodiment illustrated in FIG. 1 in which the primary fluid is cooled during its circulation through the plurality of coils 12, the primary fluid at the inlet 14 is the warmer fluid, and the primary fluid at the outlet 16 is the cooler fluid. However, in an alternative embodiment in which the primary fluid is heated during its circulation through the plurality of coils 12, the primary fluid at the outlet 16 would be the warmer fluid, and the primary fluid at the inlet 14 would be the cooler fluid.

As shown schematically in FIG. 1 by the heating flow arrow, the fluid within the first region 52 of the Stirling engine 20 of one embodiment may be in thermal communication with the warmer fluid. As a result of heat transfer from the warmer fluid to the fluid within the first region 52 of the Stirling engine 20, the fluid within the first region of the Stirling engine would be warmer than the fluid within the second region 54 of the Stirling engine, thereby establishing a temperature differential therebetween. The first region 52 of the Stirling engine 20 may be placed in thermal communication with the warmer fluid in various manners. For example, the first region 52 of the Stirling engine 20 may be at least partially disposed, such as by being immersed, within the warmer fluid. See FIG. 9A. Alternatively, the inlet 14 may be positioned so as to extend at least partially alongside the first region 52 of the Stirling engine 20. For example, the inlet 14 could wrap about the first region 52 of the Stirling engine 20 one or more times. See FIG. 9B as well as FIGS. 11 and 12 which illustrate a flow of the warmer fluid wrapping about the first region 52 of the Stirling engine 20 before returning to the flow of hot fluid into the inlet 14.

In order to establish the temperature differential between the first and second fluid-containing regions 52, 54 of the Stirling engine 20, the second region of the Stirling engine can be disposed in thermal communication with the cooler fluid, such as the primary fluid at the outlet of the plurality of coils 12 in the embodiment schematically illustrated in FIG. 5 by the cooling flow arrow. The positioning of the second fluid-containing region 54 of the Stirling engine 20 in thermal communication with the cooler fluid may be in addition to or instead of the positioning of the first fluid-containing region 52 of the Stirling engine in thermal communication with the warmer fluid. For example, the heat exchanger 10 of the embodiment of FIG. 5 schematically illustrates each of the first and second regions 52, 54 of the Stirling engine 20 being in thermal communication with the warmer fluid and the cooler fluid, respectively. The second fluid-containing region 54 of the Stirling engine 20 may be placed in thermal communication with the cooler fluid in various manners including, for example, by at least partially disposing, such as by at least partially immersing, the second fluid-containing region of the Stirling engine within the cooler fluid, such as at the outlet 16 of the plurality of coils 12 in the embodiment of FIG. 5. See FIG. 10A. Alternatively, in the embodiment of FIG. 5 in which the primary fluid is cooled during its traversal through the plurality of coils 12, the outlet 16 may be positioned so as to extend at least partially alongside the second fluid-containing region 54 of the Stirling engine 20, such as extending the outlet around the second fluid-containing region of the Stirling engine one or more times. See FIG. 10B as well as FIG. 12 which illustrates a flow of the cooler fluid wrapping about the second region 54 of the Stirling engine 20 before returning to the flow of cold fluid away from the outlet 16.

The plurality of coils 12 may include first and second sets of coils with the primary fluid being warmer in the first set of coils 12*a* than in the second set of coils 12*b*. In this regard, the coils that are proximate to, or closest to, the inlet 14 in terms of the flow of the primary fluid may be the first set of coils in an embodiment in which the heat exchanger 10 is utilized to cool the primary fluid. In this embodiment, the coils that are proximate to or closest to the outlet 16 in terms of the flow of the primary fluid may therefore be the second set of coils. In order to establish the temperature differential between the first and second fluid-containing regions 52, 54 of the Stirling engine 20, the fluid within the first region of the Stirling engine may be in thermal communication with the first set of coils in which the primary fluid is warmer. As such, the warmer fluid within the first set of coils may warm the fluid within the first region 52 of the Stirling engine 20 and create the temperature differential for causing operation of the Stirling engine. Additionally or alternatively, the fluid within the second region 54 of the Stirling engine 20 may be in thermal communication with the second set of coils having a cooler fluid therein such that the fluid within the second region of the Stirling engine is correspondingly cooled. By cooling the fluid within the second region 54 of the Stirling engine 20, the temperature differential may be created or enhanced, thereby causing operation of the Stirling engine.

The first and second regions 52, 54 of the Stirling engine 20 may be positioned in thermal communication with the first and second sets of coils, respectively, in various manners. For example, the first region 52 of the Stirling engine 20 may be positioned proximate to and in thermal communication with the first set of coils, while the second region 54 of the Stirling engine may be positioned proximate to and in thermal communication with the second set of coils. An example of a heat exchanger 10 in which the first and second regions 52, 54 of the Stirling engine 20 are in thermal communication with the first and second sets of coils, respectively, is shown in FIG. 6. In the embodiment of FIG. 6, the heat exchanger 10 is configured to cool the primary fluid such that warmer fluid enters the plurality of coils 12 through the inlet 14, and cooler fluid exits the plurality of coils through the outlet 16. As such, in the orientation of FIG. 6, the upper half of the plurality of coils 12 may be the first set of coils in which warmer fluid propagates, while the lower half of the plurality of coils may be the second set of coils through which a cooler fluid propagates as a result of the transfer of heat away from the primary fluid to the secondary fluid as the primary fluid propagates through the plurality of coils. As such, the first fluid-containing region 52 of the Stirling engine 20 of FIG. 6 is positioned proximate to, such as in physical contact and thermal communication with, the first set of coils, while the second fluid-containing region 54 of the Stirling engine is positioned proximate to and in thermal communication with the second set of coils. In the illustrated embodiment, the second fluid-containing region 54 includes a plurality of fins 55 that increase the heat transfer surface and, therefore, the cooling of the fluid within the second fluid-containing region of the Stirling engine 20. However, other embodiments of the Stirling engine 20 need not include fins 55 proximate the second region 54.

In order to create temperature differential between the first and second fluid-containing regions 52, 54 of the Stirling engine 20, the Stirling engine may be positioned relative to the fan 18 such that the first region, or at least a portion of the first region, of the Stirling engine is outside of a flow of the secondary fluid, that is, the flow of the secondary fluid created by the rotation of the fan blades. In contrast, the second region 54 of the Stirling engine 20 is at least partially within the flow of the secondary fluid. As shown in FIG. 6, for example, the second fluid-containing region 54 is disposed within the flow of the secondary fluid, while the first fluid-containing region 52 is outside of the flow of the secondary fluid. As such, the flow of the secondary fluid over the second fluid-containing region 54 of the Stirling engine 20 will also cool the fluid within the second region of the Stirling engine relative to the fluid within the first region 52 of the Stirling engine, thereby further creating or enhancing the temperature differential between the first and second fluid-containing regions that causes operation of the Stirling engine.

Another embodiment of a heat exchanger 10 in accordance with an embodiment of the present disclosure in which the Stirling engine 20 has a single cylinder as shown in FIG. 7. As shown, the first fluid-containing region 52 of the single cylinder Stirling engine 20 is positioned in thermal communication with the first set of coils as a result of its position proximate the inlet 14 through which warmer fluid enters the plurality of coils 12 in this embodiment. Additionally, the first region 52 of the Stirling engine 20 is positioned outside of the flow of the secondary fluid created by the rotation of the fan blades. Conversely, the second fluid-containing region 54 of the single cylinder Stirling engine 20 is positioned at least partially within the flow of the secondary fluid so that the fluid within the second region of the Stirling engine is cooled in order to further create the temperature differential between the first and second regions of the Stirling engine.

Although the heat exchanger 10 may include a single Stirling engine 20, the heat exchanger of at least some embodiments may include a plurality of Stirling engines operably connected to the fan 18 and configured to cooperate to cause a rotation of the fan blades. As shown in FIG. 8, for example, a heat exchanger 10 that includes two single cylinder Stirling engines 20 that are positioned in such a manner as to cooperate with one another to cause rotation of the fan blades is depicted. As described above in conjunction with the embodiment of FIG. 7, each of the single cylinder Stirling engines 20 is positioned relative to the plurality of coils 12 such that the respective first regions 52 of the Stirling engines are positioned outside of the flow of the secondary fluid, while the respective second regions 54 of the Stirling engines are positioned within the flow of the secondary fluid so as to create the temperature differential between the fluids within the first and second regions of the Stirling engines.

Many modifications and other embodiments of the present disclosure set forth herein will come to mind to one skilled in the art to which these embodiments pertain having the benefit of the teachings presented in the foregoing descriptions and the associated drawings. Therefore, it is to be understood that the present disclosure is not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A heat exchanger comprising:

a plurality of coils configured to carry a primary fluid;

a fan including a plurality of fan blades configured to force a secondary fluid across the plurality of coils to facilitate heat transfer between the primary and secondary fluids; and a Stirling engine operably connected to the fan and configured to cause rotation of the fan blades, wherein the Stirling engine includes at least one piston and first and second regions containing a working fluid, wherein respective portions of the plurality of coils, the fan and the Stirling engine are structurally aligned so as to overlie one another and to be sequentially aligned one after another along a common axis and wherein the Stirling engine is positioned relative to the fan such that the first region of the Stirling engine is outside of a flow of the secondary fluid and the second region of the Stirling engine is at least partially within the flow of the secondary fluid, wherein the plurality of coils include an inlet and an outlet through which the primary fluid enters and exits the plurality of coils, respectively, wherein the primary fluid at the inlet and the outlet has different temperatures as a result of the heat transfer such that the primary fluid at one of the inlet or the outlet is warmer and therefore includes warmer primary fluid than the primary fluid at the other of the inlet or the outlet that includes cooler primary fluid, wherein the working fluid within the second region of the Stirling engine is in thermal communication with the cooler primary fluid, and wherein the outlet extends around the second region of the Stirling engine.

2. A heat exchanger according to claim 1 wherein the working fluid within the first region of the Stirling engine is in thermal communication with the warmer primary fluid.

3. A heat exchanger according to claim 2 wherein the first region of the Stirling engine is at least partially immersed within the warmer primary fluid.

4. A heat exchanger according to claim 2 wherein the inlet wraps about the first region of the Stirling engine.

5. A heat exchanger according to claim 1 wherein the plurality of coils include first and second sections of coils with the primary fluid being warmer in the first section of coils than in the second section of coils.

6. A heat exchanger according to claim 5 wherein the working fluid within at least one of the first and second regions of the Stirling engine is in thermal communication with the first and second sections of coils, respectively.

7. A heat exchanger according to claim 1 further comprising a plurality of Stirling engines operably connected to the fan and configured to cooperate to cause rotation of the fan blades.

8. A heat exchanger according to claim 1 wherein the second region of the Stirling engine is at least partially immersed within the cooler primary fluid.

9. A method comprising steps of:

circulating a primary fluid through a plurality of coils;

providing for a temperature differential between first and second working fluid-containing regions of a Stirling engine so as to cause rotation of a plurality of fan blades of a fan; and forcing a secondary fluid across the plurality of coils as a result of the rotation of the plurality of fan blades to facilitate heat transfer between the primary and secondary fluids, wherein respective portions of the plurality of coils, the fan and the Stirling engine are structurally aligned so as to overlie one another and to be sequentially aligned one after another along a common axis and wherein providing for the temperature differential includes positioning the Stirling engine relative to the fan such that the first region of the Stirling engine is outside of a flow of the secondary fluid and the second region of the Stirling engine is at least partially within the flow of the secondary fluid, wherein the step of said circulating the primary fluid includes permitting the primary fluid to enter and exit the plurality of coils through an inlet and an outlet, respectively, wherein the primary fluid at the inlet and the outlet has different temperatures as a result of the heat transfer such that the primary fluid at one of the inlet or the outlet is warmer and therefore includes warmer primary fluid than the primary fluid at the other of the inlet or the outlet that includes cooler primary fluid, wherein the step of said providing for the temperature differential includes providing for the working fluid within the second region of the Stirling engine to be in thermal communication with the cooler primary fluid, and wherein the step of said providing for the working fluid within the second region of the Stirling engine to be in thermal communication with the cooler primary fluid includes extending the outlet around the second region of the Stirling engine.

10. A method according to claim 9 wherein the step of said providing for the temperature differential includes providing for the working fluid within the first region of the Stirling engine to be in thennal communication with the warmer primary fluid.

11. A method according to claim 10 wherein the step of said providing for the working fluid within the first region of the Stirling engine to be in thermal communication with the warmer primary fluid includes at least partially immersing the first region of the Stirling engine within the warmer primary fluid.

12. A method according to claim 10 wherein the step of said providing for the working fluid within the first region of the Stirling engine to be in thermal communication with the warmer primary fluid includes positioning the inlet so as to wrap about the first region of the Stirling engine.

13. A method according to claim 9 wherein the plurality of coils include first and second sections of coils with the primary fluid being warmer in the first section of coils than in the second section of coils, and wherein providing for the temperature differential includes providing for the working fluid within the first region of the Stirling engine to be in thermal communication with the first section of coils.

14. A method according to claim 9 wherein the plurality of coils include first and second sections of coils with the primary fluid being warmer in the first section of coils than in the second section of coils, and wherein providing for the temperature differential includes providing for the working fluid within the second region of the Stirling engine to be in thermal communication with the second section of coils.

15. A method according to claim 9 wherein the step of said providing for the working fluid within the second region of the Stirling engine to be in thermal communication with the cooler primary fluid includes at least partially immersing the second region of the Stirling engine within the cooler primary fluid.

* * * * *